United States Patent [19]

Nishi et al.

[11] Patent Number: 4,684,942

[45] Date of Patent: Aug. 4, 1987

[54] VIDEO DISPLAY CONTROLLER

[75] Inventors: Kazuhiko Nishi; Takatoshi Ishii; Ryozo Yamashita, all of Tokyo; Shigemitsu Yamaoka; Takatoshi Okumura, both of Hamamatsu, all of Japan

[73] Assignees: Ascii Corporation, Tokyo; Nippon Gakki Seizo Kabushiki Kaisha, Hamamatsu, both of Japan

[21] Appl. No.: 736,761

[22] Filed: May 22, 1985

[51] Int. Cl.[4] ..... G09G 1/28

[52] U.S. Cl. ..... 340/703; 340/701; 340/799

[58] Field of Search ..... 340/747, 748, 750, 703, 340/701, 745, 802, 799; 365/230

[56] References Cited

U.S. PATENT DOCUMENTS

| | | | |
|---|---|---|---|
| 3,854,130 | 12/1974 | Ligocki | 340/703 |
| 3,944,999 | 3/1976 | Moore | 340/703 |
| 4,016,544 | 4/1977 | Morita et al. | 340/703 X |
| 4,310,838 | 1/1982 | Juso et al. | 340/701 |
| 4,360,804 | 11/1982 | Ohura | 340/703 |
| 4,368,461 | 1/1983 | Komatsu et al. | 340/703 |
| 4,442,428 | 4/1984 | Dean et al. | 340/703 |
| 4,590,463 | 5/1986 | Smollin | 340/703 |

*Primary Examiner*—Marshall M. Curtis
*Assistant Examiner*—Jeffery A. Brier
*Attorney, Agent, or Firm*—Cushman, Darby & Cushman

[57] ABSTRACT

A video display controller is provided with a color palette circuit which is capable of converting, at a high conversion rate, color codes read from a VRAM (video RAM) into RGB color data to be supplied to a CRT display unit. The color palette circuit comprises a plurality of color data registers each storing one RGB color data and is supplied with a timing signal synchronized with the display timing of display elements on the CRT display screen. Each color code data including at least two color codes and read from an address of the VRAM is first supplied to a selection circuit which includes at least two decoders. Each decoder decodes the corresponding color codes to generate a selection signal which enables one of the color data registers to output the RGB color data contained therein. Thus, at least two RGB color data are outputted from the color data registers enabled by the outputs of the decoders, and are supplied to an output control circuit which outputs each of these RGB color data in a multiplexing fashion in accordance with the timing signal.

4 Claims, 10 Drawing Figures

VIDEO DISPLAY CONTROLLER

BACKGROUND OF THE INVENTION

1. Field of the Invention

The present invention relates to a video display controller for use in terminal equipment for a computer, television game apparatus or the like.

2. Prior Art

Recently, various kinds of display control systems which display animation and still images on a screen of a CRT (cathode-ray tube) display unit under the control of a CPU (central processing unit) have been developed. FIG. 1 shows one example of such conventional systems which comprises a video display controller (hereinafter referred to as "VDP") 101 and a central processing unit (CPU) 102. The system further comprises a memory 103 which includes a ROM (read only memory) for storing a variety of programs to be executed by the CPU 102 and a RAM (random access memory) for storing other necessary data. The CPU 102 outputs data representative of still and animation images to be displayed on a screen of a CRT display unit 105 to the VDP 101 which in turn stores the still and animation data into a video RAM (hereinafter referred to as "VRAM") 104.

Upon receipt of a display command from the CPU 102, the VDP 101 sequentially reads the still and animation data from the VRAM 104 in accordance with scanning synchronization signals of the CRT display unit 105, and supplies the read data to the CRT display unit 105, thereby the still and animation images being displayed on the screen of the CRT display unit 105.

Such a kind of display controller described above is generally provided with a kind of code converter called a color palette circuit. The color palette circuit converts each of color codes (codes for designating colors of display elements which constitute still and animation images on the screen) read from the VRAM into three color data RD (red), GD (green) and BD (blue). These color data RD, GD and BD each composed of about three bits are then converted respectively into analog color signals R, G and B to be supplied to the CRT display unit.

In such a display control system, when the number of display elements or dots on the display screen is increased to improve the quality of display image, the rate of conversion of color codes of the color palette circuit must also be increased. Incidentally, it has become common that such a video display controller incorporating a color palette circuit is constructed as an LSI. And therefore, in order to increase the conversion rate of a color pallete circuit, the following problems must have been solved.

When it is desired to increase the conversion rate, the propagation delay at each circuit component of the color palette circuit portion in the LSI must be reduced by increasing its circuit current. However, to increase the circuit current, the area of the each circuit component must be increased, which results in an increase of circuit areas of the color palette circuit portion in the LSI. In addition, when the circuit current is increased, the power dissipation and generation of heat of the color palette circuit portion of the LSI is increased.

SUMMARY OF THE INVENTION

It is therefore an object of the present invention to provide a video display controller having a color palette circuit in which conversion of data can be performed at a high rate without the increase of size and power dissipation of the color palette circuit.

According to one aspect of the present invention, there is provided a video display controller adapted to be connected to memory means storing a plurality of color codes and a video display unit, for reading the color codes from the memory means and for displaying a plurality of display elements constituting an image on a screen of the video display unit in accordance with the color codes read from the memory means, the video display controller comprising: (a) signal generator means for generating a timing signal synchronized with the display timing of the display elements on the screen; (b) a plurality of register means each for storing color data representative of one of predetermined colors of the display elements; (c) selection circuit means having at least two input ports each for being suppied with one of the color codes read from the memory means, the selection circuit means in response to each of the color codes supplied to the input ports enabling one of the plurality of register means to output the color data contained therein; and (d) output control circuit means for being supplied with the color data outputted from the selected register means and responsive to the timing signal for outputting each of the supplied color data in a predetermined order to the video display unit.

DESCRIPTION OF THE PREFERRED EMBODIMENT OF THE INVENTION

Figure 2:
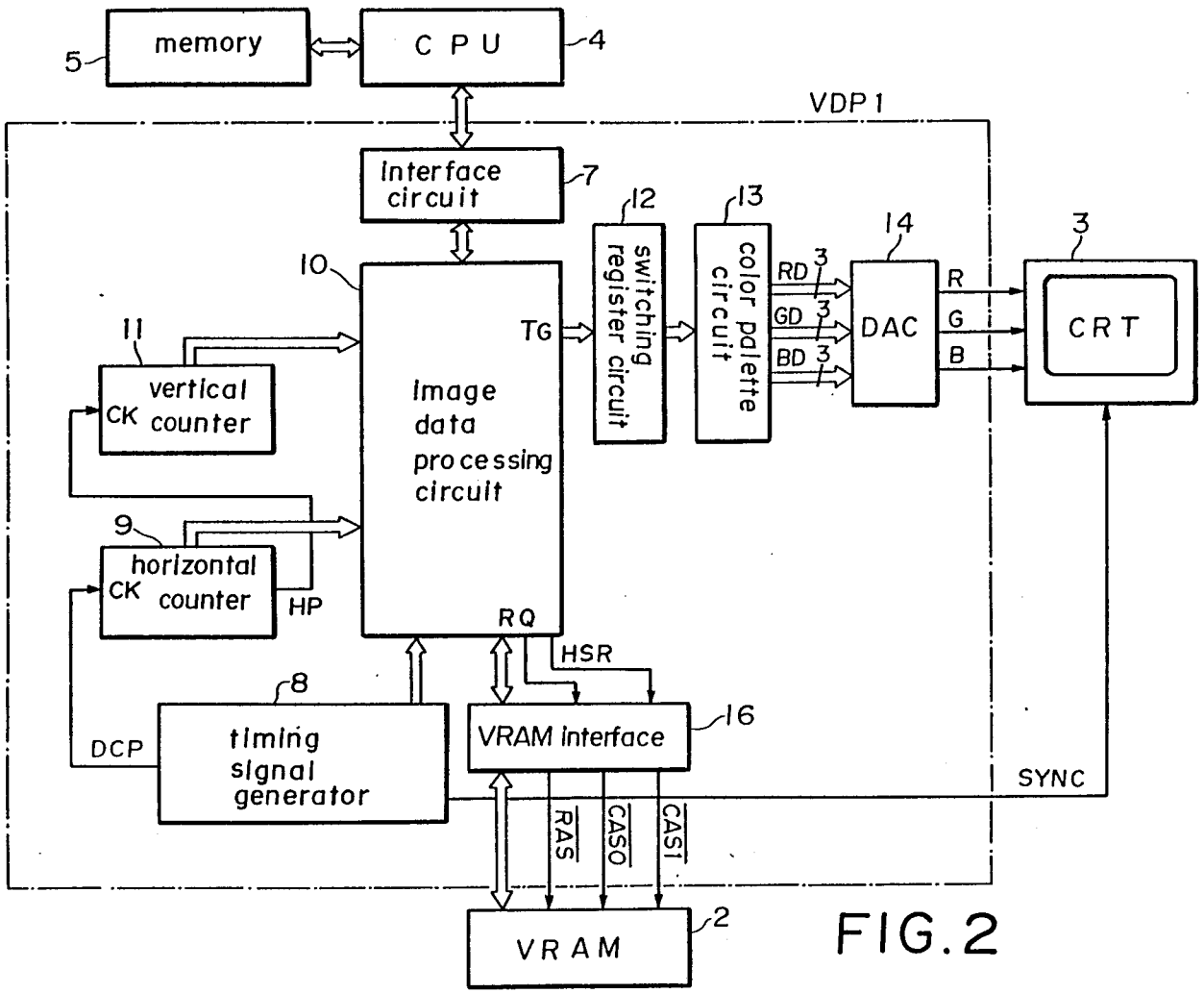
FIG. 2 is a block diagram of a video display control system which includes a video display controller 1 provided in accordance with the present invention.

Shown in FIG. 2 is a video display control system which includes a video display controller 1 (hereinafter, referred to as "VDP") provided in accordance with the present invention. The VDP 1 causes an animation and a still image to be displayed on a screen of a CRT display unit 3 in accordance with imaga data stored in a VRAM (video RAM) 2. Also, the VDP 1 allows the contents of the VRAM 2 to be changed and causes a part of the contents of the VRAM 2 to be transferred to the outside in accordance with various kinds of commands or image data supplied from a CPU (central processing unit) 4. A memory 5 stores programs to be executed by the CPU 4 and also stores various kinds of image data.

The VDP 1 will now be more fully described.

A timing signal generator 8 shown in FIG. 2 generates a reference clock pulse by means of a crystal oscillator provided therein, and generates, in accordance with the reference clock pulse, a dot clock pulse DCP and a synchronization signal SYNC. The dot clock pulse DCP is outputted to a clock terminal CK of a horizontal counter 9, while the synchronization signal SYNC is outputted to the CRT display unit 3. The dot clock pulse DCP corresponds to each display element displayed on the CRT display screen, in other words, the dot clock pulse DCP is synchronized with a display timing of each of display elements which are sequentially displayed on the screen in accordance with the horizontal scanning of the screen. The timing signal generator 8 also generates various kinds of timing signals necessary for processing the image data and outputs them to an image data processing circuit 10.

The horizontal counter 9 is reset when each horizontal scanning of the screen is started, and each time a predetermined number of dot clock pulses DCP are counted, the horizontal counter 9 outputs a signal HP to a clock terminal CK of a vertical counter 11. An output of this horizontal counter 9 represents the sequential number of the display elements on a horizontal scanning line which is being scanned, the display elements being counted from the leftmost one on the horizontal scanning line. For example, when the output of the horizontal counter 9 is "0" an electron beam of the CRT display unit 3 is directed to the leftmost display element on a horizontal scanning line, and when the output of the horizontal counter 9 is "100" the electron beam is directed to the 101st display element on a horizontal scanning line.

The vertical counter 11 is reset each time the vertical scanning of the screen is started, so that the content of the vertical counter 11 represents the sequential number of the horizontal scanning line which is being scanned, the horizontal scanning lines being scanned by an electron beam from the top to the bottom of the screen. In this embodiment, the horizontal scanning lines are counted from the uppermost one on the screen and the number of the horizontal scanning lines on the display screen is set to "192".

Figure 3:
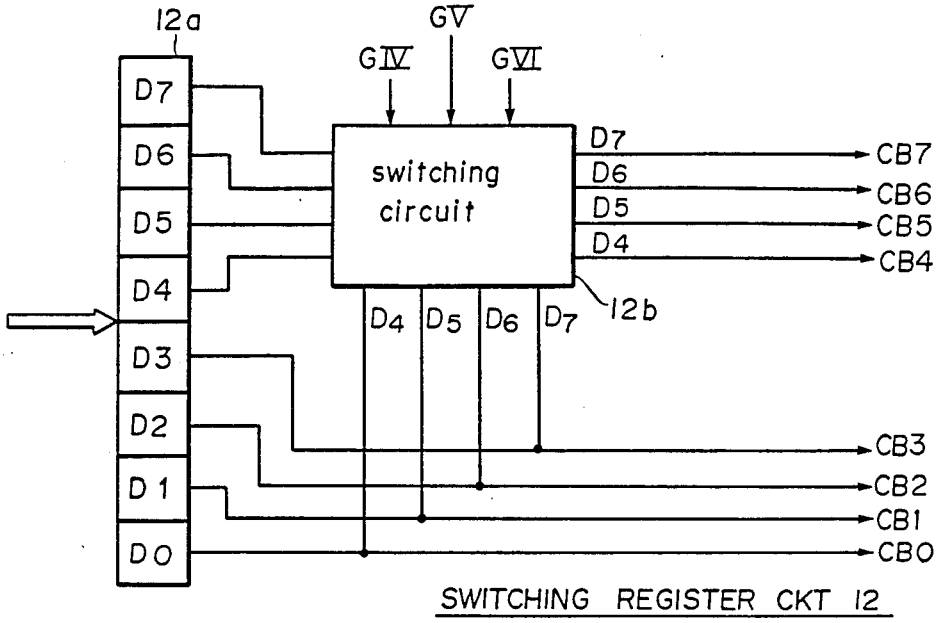
FIG. 3 is a block diagram of a switching register circuit 12 of the video display controller 1 of FIG. 2.
Figure 4:
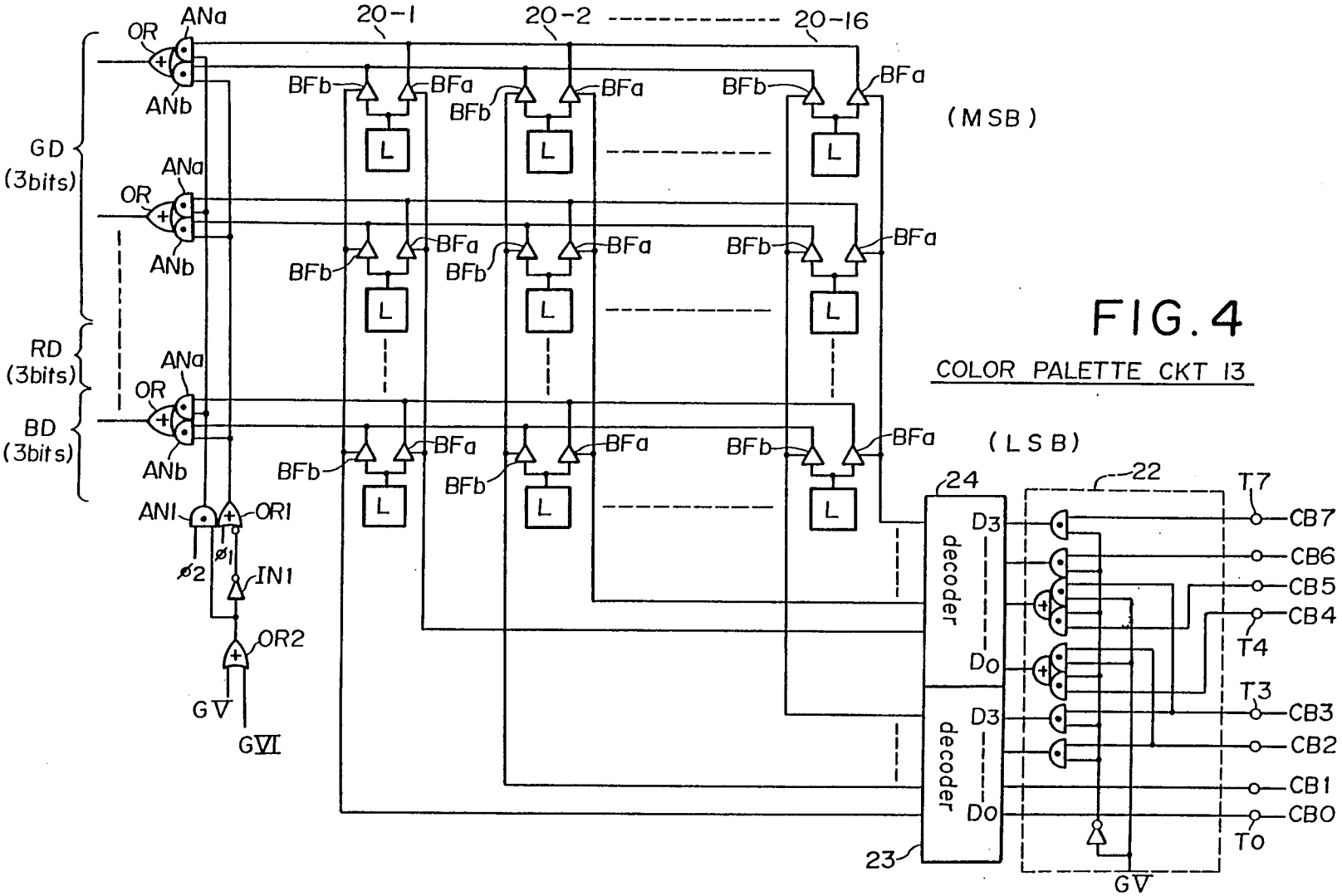
FIG. 4 is a circuit diagram of a color palette circuit 13 of the video display controller 1 of FIG. 2.

The image data processing circuit 10 sequentially stores the image data (still imgae data and animation image data), which are supplied from the CPU 4 through an interface circuit 7, into respecitve table areas of the VRAM 2. After completion of the storage of the image data into the VRAM 2, and when a display command is outputted from the CPU 4, the image data processing circuit 10 performs the display of the still and animation images in accordance with each image data in the VRAM 2. The display of the still image is performed by reading out color codes, which are the codes designating colors of display elements to be displayed and constitute the still image and animation image data, from the VRAM 2 in accordance with the scanning position of the electron beam indicated by the contents of the horizontal counter 9 and vertical counter 11, and by sequentially outputting those color codes (each composed of 2, 4 or 8 bits) from a terminal TG thereof through a switching register circuit 12 to a color palette circuit 13. At the same time, the image data processing circuit 10 calculates and reads data necessary for displaying the animation image from the VRAM 2, and then supplies color codes obtained as the result of the above operation to the color palette circuit 13. Incidentally, in the case where the animation image and the still image are located at the same display position on the screen, the animation image is preferentially displayed. The switching register circuit 12 comprises, as shown in FIG. 3, an eight-bit register **12*a* for storing each color-code data read from the VRAM 2, a switching circuit 12*b* which outputs the upper four-bit data (D4 to D7) contained in the register 12*a* selectively onto the upper four bit-lines CB4 to CB7 and the lower four bit-lines CB0 to CB3 of a color bus in accordance with mode signals GIV, GV and GVI. The lower four-bit data (D0 to D3) contained in the register 12*a* is always outputted onto the lower four bit-lines CB0 to CB3 of the color bus and these bit lines CB0 to CB7 are connected respectively to input terminals T0 to T7 of the color palette circuit 13 (FIG. 4). The operation of the switching circuit 12*b*** will be described later.

The color palette circuit 13 is a kind of code converter and converts each color code of 2, 4 or 8 bits supplied from the switching register circuit 12 into red color data RD, green color data GD and blue color data BD (each of these color data consists of three bits) and outputs them to a DAC (digital-to-analog converter) 14. The DAC 14 converts the color data RD, GD and BD into analog color signals R, G and B, respectively, and then outputs these color signals R, G and B to the CRT display unit 3.

Figure 5:
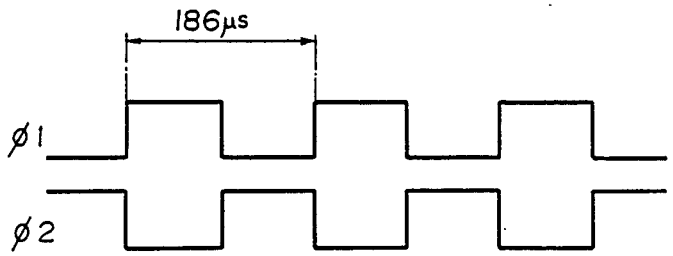
FIG. 5 is a time chart of pulse signals $\phi 1$ and $\phi 2$ appearing in the color palette circuit 13 of FIG. 4.

FIG. 4 shows the contruction of the color palette circuit 13. Shown at L, L, . . . in FIG. 4 are one-bit registers, into each of which bit data of "1" or "0" is previously stored. Nine of these registers L, L, . . . each accompanying a pair of tri-state buffer amplifiers BFa and BFb constitute one of sixteen color-data output sections 20-1 to 20-16. Each pair of the tri-state buffer amplifiers BFa and BFb is connected to the register L so as to enable or disable the output of the content of the corresponding register L. In this case, the nine registers L constituting each of the color-data output sections 20-1 to 20-16 are grouped on a three-register unit basis from the LSB thereof into three portions which output the blue color data BD, red color data RD and green color data GD, respectively. More specifically, the first to third bits of each color-data output section output the blue color data BD, the fourth to sixth bits output the red color data RD, and the seventh to ninth bits output the green color data GD. Nine AND gates ANa and nine AND gates ANb are respectively provided in correspondence to each bit portion of the respective color-data output sections 20-1 to 20-16. Output terminals of the buffer amplifiers BFa corresponding to the same bit portion of the respective color-data output sections 20-1 to 20-16 are connected to one input terminal of the corresponding AND gate ANa. In a similar manner, output terminals of the buffer amplifiers BFb corresponding to the same bit portion of the respective color-data output sections 20-1 to 20-16 are connected to one input terminal of the corresponding AND gate ANb. The other input terminals of the AND gates ANa are connected to an output terminal of an AND gate AN1. And the other input terminals of the AND gates ANb are connected to an output terminal of an OR gate OR1. One input terminal of the OR gate OR1 is connected to an output terminal of an inverter IN1 whose input terminal is supplied with an output signal of an OR gate OR2. The output signal of this OR gate OR2 is also supplied to one input terminal of the AND gate AN1. Input terminals of the OR gate OR2 are supplied with the mode signals GV and GVI which are rendered "1" in G V and G VI dispaly modes, respectively, as will be described later. Pulse signals $\phi 1$ and $\phi 2$ are supplied to the other input terminals of the AND gate AN1 and OR gate OR1, respectively. As shown in FIG. 5, the pulse signals $\phi 1$ and $\phi 2$ are 180° out of phase from each other and each of the pulse signals has a period of 186 nsec. The period of 186 nsec corresponds to a time period required to display one display element when 256 dots are to be displayed on one horizontal scanning line.

A bit shift circuit 22 in FIG. 4 operates only in the G V mode and supplies the data on the bit lines CB2 and CB3 of the color bus to input terminals D0 and D1 of a binary-to-decimal decoder 24 and at the same time prevents the data on the bit lines CB2, CB3, CB6 and CB7 of the color bus from being supplied to input terminals D2 and D3 of a binary-to-decimal decoder 23 and of the decoder 24. When the bit shift circuit 22 is in the inoperative state, the data on the bit lines CB0 to CB3 are supplied to the input terminals D0 to D3 of the decoder 23, and the data on the bit lines CB4 to CB7 are supplied to the input terminals D0 to D3 of the decoder 24. Each of the decoders 23 and 24 outputs a selection signal to select one of the color-data output sections 20-1 to 20-16 in accordance with the data supplied to the input terminals D0 to D3 thereof. In this case, the selection signals outputted from the decoder 23 are supplied to the buffer amplifiers BFb as enable signals, while the selection signals outputted from the decoder 24 are supplied to the buffers BFa as enable signals. Therefore, output signals of the registers L of the color-data output section selected by the decoder 23 are supplied to the one input terminals of the AND gates ANb. On the other hand, the contents of the registers L of the color-data output section selected by the decoder 24 are supplied to the one input terminals of the AND gates ANa.

Referring to FIG. 2, shown at 16 is a VRAM interface for controlling transfer of data between the image data processing circuit 10 and the VRAM 2. The VRAM interface 16 outputs at a proper timing a row address strobe signal $\overline{RAS}$ and column address strobe signals $\overline{CAS0}$ and $\overline{CAS1}$ to the VRAM 2 in response to a VRAM access request signal RQ and a high speed read signal HSR which are supplied from the image data processing circuit 10. After outputting the signal $\overline{RAS}$, the VRAM interface 16 outputs only the signal $\overline{CAS0}$ when the access request signal RQ is supplied but when the signal HSR is not supplied. On the other hand, when the signal HSR is supplied together with the signal RQ, the VRAM interface 16 sequentially outputs the signals $\overline{CAS0}$ and $\overline{CAS1}$ after outputting the signal $\overline{RAS}$.

The mode of this system to display a still image will now be described.

There are a plurality of still image display modes in this system which are broadly classified into a pattern display mode in which selected patterns each composed of, for example, 8×8 or 8×6 display elements are displayed, and a dot-map mode in which colors of the display elements constituting the entire display screen are designated individually. This dot-map mode further includes three kinds of display modes, namely, G IV, G V and G VI modes.

Each of those display modes will now be described.

(1) G IV mode

Figure 6A:
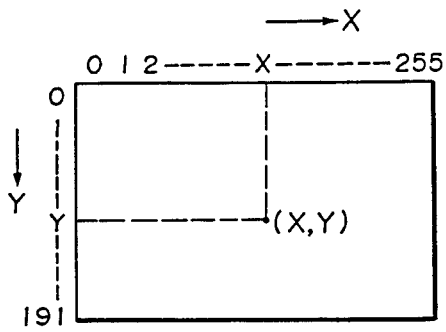
FIG. 6 is an illustration showing the relation between display elements on the screen and the corresponding color codes stored in the VRAM 2 in G IV mode.
Figure 6B:
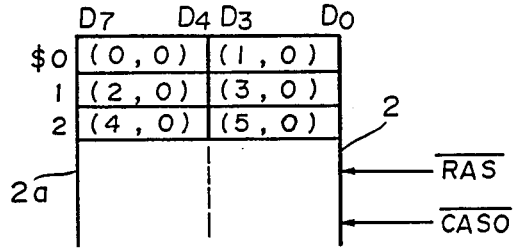

In this G IV mode, the screen is constituted by 256×192 display elements as shown in FIG. 6-(*a*) and color codes corresponding respectively to those display elements are stored in a still image data area 2*a* of the VRAM 2 in the order shown in FIG. 6-(*b*). In this case, each color code is composed of four bits so that each address of the still image data area 2*a* stores two color codes. And as each color code is composed of four bits, one of sixteen colors can be designated with respect to each display element in this display mode.

(2) G V mode

Figure 7A:
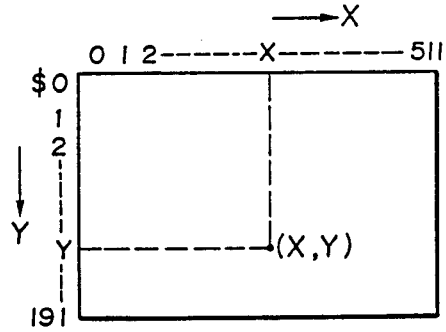
FIGS. 7 and 8 are illustrations similar to FIG. 6 but showing such relations in G V mode and G VI mode, respectively.
Figure 7B:
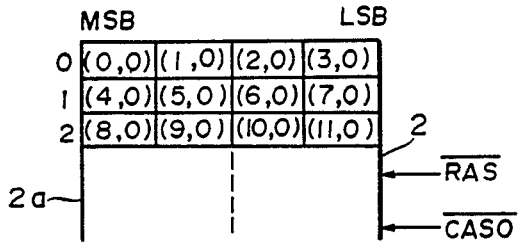

In this G V mode, as shown in FIG. 7-(*a*), the screen is constituted by 512×192 display elements and the color codes of all the display elements are stored in the still image data ares 2*a* in the order shown in FIG. 7-(*b*). Each color code in this mode consists of two bits and four color codes are stored in each address of the still image data area 2a. In the G V mode, the number of bits of one color code is two, so that up to four colors can be designated per one display element. The VRAM 2 in this G V mode and in the foregoing G IV mode is constituted by dynamic RAMs having addresses each composed of eight bits. The VRAM 2 latches a row address when the signal $\overline{RAS}$ is supplied and latches a column address when the signal $\overline{CAS0}$ is supplied. An address to be accessed is thus specified when both of the signals $\overline{RAS}$ and $\overline{CAS0}$ are supplied.

(3) G VI mode

Figure 8A:
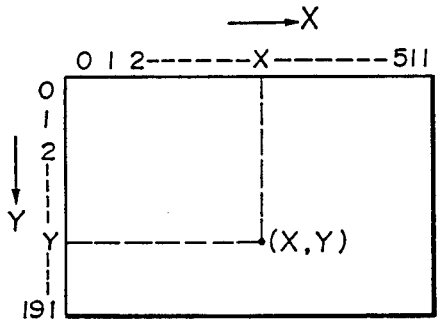
Figure 8B:
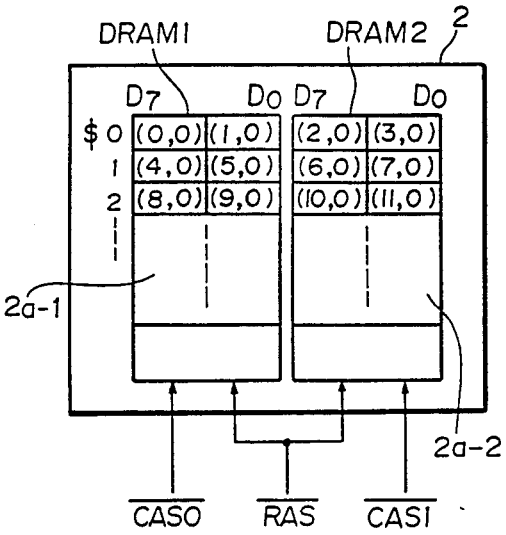

In this mode, as shown in FIG. 8-(*a*), the screen is constituted by 512×192 display elements and each color code is composed of four bits similarly to the G IV mode. In this G VI mode, storage area of the VRAM 2 is formed by two dynamic RAMs DRAM1 and DRAM2 as shown in FIG. 8-(*b*). Color codes corresponding to all display elements on the display screen are stored in still image data areas 2*a*-1 and 2*a*-2 provided respectively in the DRAM1 and DRAM2 in the order shown in FIG. 8-(*b*). In this case, the DRAM1 and DRAM2 are arranged so as to have the same addresses.

The operation of this system will now be described.

The operation of this system in the G IV and G V modes will be first described. In these modes, the number of bits of the still image data which are read out from the VRAM 2 during one horizontal scanning is 1024 (4 bits×256=1024 bits) in the G IV mode and is 1024 (2 bits×512=1024 bits) in the G V mode. In other words, in any of these modes, it is necessary to read out 1024 bits (128 bytes) of data during a time period when one horizontal scanning is performed. In the case of reading out the still image data of about 128 bytes during one horizontal scanning, it is not necessary to provide an extremely high access speed, and therefore, an access to the VRAM 2 similar to the conventional manner is performed. More specifically, the image data processing circuit 10 calculates each address of the VRAM 2, in which color codes necessary for displaying corresponding display elements of a still image are stored, in accordance with the contents of the horizontal and vertical counters 9 and 11. Then, the image data processing circuit 10 sequentially outputs to the VRAM 2 the row address and column address corresponding to the calculated address. At the same time, the VRAM interface 16 sequentially outputs the row address strobe signal $\overline{RAS}$ and column address strobe signal $\overline{CAS0}$ to the VRAM 2. As a result, an access to the address of the VRAM 2 is established, so that the color codes are read from the accessed address and supplied through the VRAM interface 16 to the image data processing circuit 10.

Figure 9:
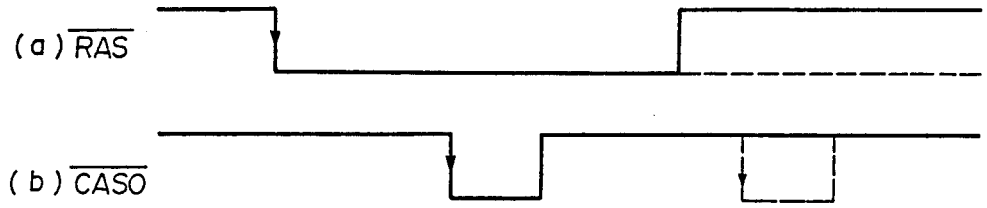
FIG. 9 is a time chart of the signals $\overline{RAS}$ and $\overline{CAS0}$ supplied to the VRAM 2 of FIG. 2 in the G IV and G V modes.

FIGS. 9-(*a*) and 9-(*b*) show the signals $\overline{RAS}$ and $\overline{CAS0}$ which are outputted from the VRAM interface 16 in the foregoing case. As shown in FIGS. 9-(*a*) and 9-(*b*), when the access request signal RQ is outputted from the image data processing circuit 10, the VRAM interface 16 first outputs the signal $\overline{RAS}$ and then outputs the the signal $\overline{CAS0}$ after a predetermined time. The VRAM 2 latches the row address at the leading edge of the signal $\overline{RAS}$ and latches the column address at the leading edge of the signal $\overline{CAS0}$. After a lapse of a predetermined time from the leading edge of the signal $\overline{CAS0}$, the VRAM 2 outputs the color code data, which includes two color codes in case of the G IV mode and four color codes in case of the G V mode, from the accessed address. Then, the VRAM interface 16 stops the output of the signals $\overline{CAS0}$ and $\overline{RAS}$. And thereafter, each time the image data processing circuit 10 outputs new address data, the VRAM interface 16 performs an operation similar to the above operation. In this case, if the row address of each of the addresses to be accessed does not change, the output of the signal $\overline{RAS}$ is held unchanged as indicated by a broken line in FIG. 9-(*a*) and the signal $\overline{CAS0}$ is outputted each time a new column address is outputted from the image data processing circuit 10.

One byte of data read from the accessed address of the VRAM 2 is once stored in the register 12*a* of the switching register circuit 12 and the switching circuit 12*b* outputs in sequence the upper four bits and the lower four bits of the stored data onto the bit lines CB0 to CB3 of the color bus.

Next, the operation of the color palette circuit 13 will be described with respect to each of the G IV and G V modes.

(a) G IV mode

In this mode, each data which is outputted onto the bit lines CB0 to CB3 constitutes a color code repersentative of a color of one display element and this color code is supplied through the bit shift circuit 22 to the input terminals D0 to D3 of the decoder 23. The decoder 23 then outputs one of the selecting signals so that one of the color-data output sections 20-1 to 20-16 is selected in accordance with the color code supplied thereto. The color data RD, GD and BD in the registers L of the thus selected color-data output section are supplied to the one input terminals of the AND gates ANb through the selected buffer amplifiers BFb. Incidentally, in this G IV mode, the output signal of the OR gate OR2 is "0", so that the output signal of the AND gate AN1 is always "0" and the output signal of the OR gate OR1 is always "1". And therefore, the AND gates ANb are always open in the G IV mode, so that the color data RD, GD and BD, which are supplied to the one input terminals of the AND gates ANb through the selected buffer amplifiers BFb, are supplied to the DAC 14 through the OR gates OR. As a result, the display element corresponding to the color code read out from the VRAM 2 is displayed in a color designated by the color code on the display screen. In this case, each color code is supplied to the color palette circuit 13 in synchronization with the pulse signal $\phi 1$ so that 256 display elements are displayed on one horizontal scanning line.

(b) G V mode

In this mode, each data which is sequentially outputted onto the bit lines CB0 to CB3 of the color bus includes two color codes. The bit shift circuit 22 supplies one of the two color codes on the bit lines CB0 and CBl to the input terminals D0 and D1 of the decoder 23 and supplies the other one of the two color codes on the bit lines CB2 and CB3 to the input terminals D0 and D1 of the decoder 24. Each of the decoders 23 and 24 then outputs the corresponding selecting signal so that one of the color-data output sections 20-1 to 20-16 (actually, one of predetermined four color-data output sections) is selected in accordance with the color code supplied thereto. The color data in the registers L of the color-data output section thus selected by the decoder 23 are supplied to the one input terminals of the AND gates ANb through the selected buffer amplifiers BFb. In a similar manner, the color data in the registers L of the color-data output section thus selected by the decoder 24 are supplied to the one input terminals of the AND gates ANa through the selected buffer amplifiers BFa. Incidentally, in this G V mode, the output signal of the OR gate OR2 is "1", so that the pulse signals $\phi 1$ and $\phi 2$ are supplied to the other input terminals of the AND gates ANb and the other input terminals of the AND gates ANa through the OR gate OR1 and the AND gate AN1, respectively. Consequently, the AND gates ANa and AND gates ANb alternately open, so that the color data in the color-data output section selected by the decoder 23 and the color data in the color-data output section selected by the decoder 24 are alternately outputted through the OR gates OR. Thus, the interval of the output of each color data through the OR gates OR becomes half of that of the pulse signal $\phi 1$ ($\phi 2$), so that 512 display elements can be displayed on one horizontal scanning line. Each color code is supplied to the color palette circuit 13 in synchronism with the pulse signal $\phi 1$ ($\phi 2$) in a similar manner as described for the foregoing case (a).

The operation of this system in the G VI mode will now be described. In this mode, the number of bits of a still image data which are read out from the VRAM 2 during one horizontal scanning is 2048 (four bits$\times$512=2048 bits) so that 256 bytes of data must be read out from the VRAM 2. To read out the still image data of about 256 bytes for displaying display elements on one horizontal scanning line, it is necessary to provide an extremely high-speed access to the VRAM 2. In this embodiment, this high-speed access is realized in a manner describe below.

When making an access to the VRAM 2, the image data processing circuit 10 outputs both of the access request signal RQ and high speed read signal HSR to the VRAM interface 16 and also outputs a row address data to the VRAM 2. Subsequently, the VRAM interface 16 outputs the signal $\overline{RAS}$ (FIG. 10-(*a*), and both of the DRAM1 and DRAM2, which constitute the VRAM 2, latch the row address at the leading edge of the signal $\overline{RAS}$. When the image data processing circuit 10 outputs the column address data and when the VRAM interface 16 outputs the signal $\overline{CAS0}$ (FIG. 10-(*b*)), an access to the address of the DRAM1 is established at the leading edge of this signal $\overline{CAS0}$. As a result, the color code data (one byte) in the accessed address is read out and supplied to the image data processing circuit 10 through the VRAM interface 16. Subsequently, the VRAM interface 16 renders the signal $\overline{CAS0}$ high and immediately after that, it outputs the signal $\overline{CAS1}$. The access to the address of the DRAM2 is established at the leading edge of the signal $\overline{CAS1}$ and the color code data (one byte) in the accessed address is read and supplied to the image data processing circuit 10. The address of the DRAM2 accessed at this time is the same as that of the DRAM1 previously accessed, since the column address has not been changed. Then, the VRAM interface 16 renders the signals $\overline{CAS1}$ and $\overline{RAS}$ high, thereby a series of accessing processing being completed. And thereafter, each time the image data processing circuit 10 outputs new address data, the above operation is carried out.

Figure 10:
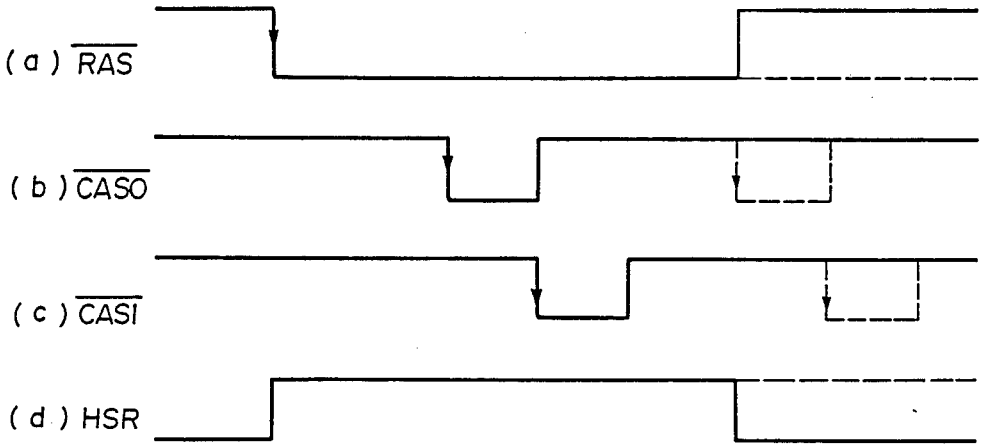
FIG. 10 is a time chart of the signals $\overline{RAS}$, $\overline{CAS0}$, $\overline{CAS1}$ and HSR in the G VI mode.
Figure 1:
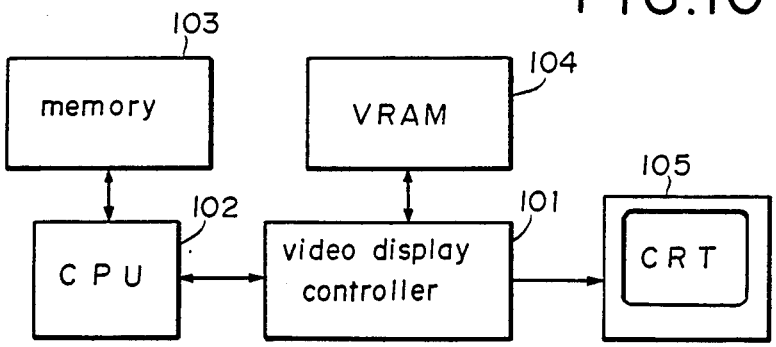
FIG. 1 (PRIOR ART)
FIG. 1 is a block diagram of a conventional video display control system.

In the case where the row address of each of the addresses to be accessed does not change, the output of the signals $\overline{RAS}$ and HSR may be kept active as indicated by broken lines in FIGS. 10-(*a*) and 10-(*d*), and each time a new column address is outputted from the image data processing circuit 10, the signals $\overline{CAS0}$ and $\overline{CAS1}$ are outputted at timings indicated by broken lines in FIGS. 10-(*b*) and 10-(*c*).

The color code data thus read from the DRAM1, which includes two color codes, is temporarily stored in the register 12*a* of the switching register circuit 12 and is then outputted onto the bit lines CB0 to CB7 of the color bus. And thereafter, the color code data read out from the DRAM2 is temporarily stored in the register 12*a* and is then outputted onto the bit lines CB0 to CB7. The decoders 23 outputs the selection signal to select one of the color-data output sections 20-1 to 20-16 in accordance with the lower four bits of the color code data read from the DRAM1, while the decoder 24 outputs the selection signal to select one of the color-data output sections 20-1 to 20-16 in accordance with the higher four bits of the same color code data. And thereafter, the decoders 23 outputs the selection signal to select one of the color-data output sections 20-1 to 20-16 in accordance with the lower four bits of the color code data read from the DRAM2, while the decoder 24 outputs the selection signal to select one of the color-data output sections 20-1 to 20-16 in accordance with the higher four bits of the same color code data. The output signals of the OR gates OR1 and OR2 and AND gate AN1 in this G VI mode are in the same states as those in the case of the foregoing G V mode. Therefore, the color data in the color-data output section selected by the decoder 23 and the color data in the color-data output section selected by the decoder 24 are alternately outputted through the OR gates OR. Thus, 512 display elements are displayed on one horizontal scanning line.

As described above, according to the foregoing embodiment, the output rate of color data of the color palette circuit 13 is twice as high as the input rate of color code data thereof, so that the color palette circuit can achieve the conversion of color code into color data at a high rate without the increase of the circuit current, thereof. Thus, the color palette circuit of the video display controller provided in accordance with the present invention requires less increase of the circuit area in the LSI in comparison with the conventional color palette circuit, and the increase of the power dissipation of the color pallete circuit is minimum.

What is claimed is:

1. A video display controller adapted to be connected to a video display unit having a screen on which a plurality of display locations each for displaying a display element are provided and memory means for storing a plurality of color codes each for designating a color of a respective one of the display elements, said video display controller receiving the color codes read from the memory means, converting each of the received color codes into color data representative of color components of the color designated thereby and causing each of the display elements to be displayed in accordance with the color data to thereby display an image on the screen, said video display controller comprising:

signal generator means for generating a timing signal synchronized with the display timing of the display elements on the screen; and converter means for converting each of the color codes read from the memory means into the corresponding color data, said converter means including:

a plurality of register means each for storing color data respective of color components which constitute one of predetermined colors;

selection circuit means having at least two input ports for respectively receiving at a time at least two of the color codes read from the memory means, said selection circuit means in respose to each of said received at least two color codes enabling one of said plurality of register means to output the color data contained therein; and output control circuit means for being supplied with the color data outputted from those of said plurality of register means which are selected by said at least two color codes and responsive to said timing signal for outputting the supplied color data in a predetermined order in a multiplexed state.

2. A video display controller according to claim 1, wherein said selection circuit means comprises at least two decoders each having an input terminal for being supplied with a color code and an output terminal for outputting signals representative of decoded results of the supplied color code, said input ports of said selection circuit means being said input terminals of said decoders, respectively, said signals outputted from each of said output terminals of said decoders being supplied respectively to said plurality of register means for enabling one of said plurality of register means to output the color data contained therein.

3. A video display controller according to claim 2, wherein each of said register means further comprises transfer gate means equal in number to said decoders, each of said signals outputted from said output terminals of said decoders being supplied to the corresponding one of said transfer gate means of the respective register means.

4. A video display controller according to claim 3, wherein said output control means comprises multiplexer means for multiplexing color data outputted from said transfer gate means of each of said register means in accordance with said timing signals.

* * * * *

UNITED STATES PATENT AND TRADEMARK OFFICE

CERTIFICATE OF CORRECTION

PATENT NO. : 4,684,942

DATED : August 4, 1987

INVENTOR(S) : NISHI, et al.

It is certified that error appears in the above-identified patent and that said Letters Patent is hereby corrected as shown below:

In the Heading add the following:

[30] Foreign Application Priority Data

May 24, 1984 [JP] Japan ..... 59-105574

Signed and Sealed this

Twenty-fourth Day of January, 1989

*Attest:*

*Attesting Officer*

DONALD J. QUIGG

*Commissioner of Patents and Trademarks*